US012472395B2

(12) United States Patent
Sorin

(10) Patent No.: US 12,472,395 B2
(45) Date of Patent: Nov. 18, 2025

(54) WEIGHT RACK SYSTEM AND METHODS OF MAKING AND USING SAME

(71) Applicant: Albert Sorin, Lexington, SC (US)

(72) Inventor: Albert Sorin, Lexington, SC (US)

( * ) Notice: Subject to any disclaimer, the term of this patent is extended or adjusted under 35 U.S.C. 154(b) by 480 days.

(21) Appl. No.: 17/218,441

(22) Filed: Mar. 31, 2021

(65) Prior Publication Data

US 2021/0308516 A1 Oct. 7, 2021

Related U.S. Application Data

(60) Provisional application No. 63/003,550, filed on Apr. 1, 2020.

(30) Foreign Application Priority Data

May 18, 2020 (GB) ..... 2007330

(51) Int. Cl.
*A63B 21/078* (2006.01)
*A63B 21/16* (2006.01)
*A63B 71/00* (2006.01)

(52) U.S. Cl.
CPC ..... *A63B 21/078* (2013.01); *A63B 21/169* (2015.10); *A63B 71/0036* (2013.01)

(58) Field of Classification Search
CPC ..... A63B 1/00; A63B 21/026; A63B 21/078; A63B 21/0783; A63B 21/169; A63B 21/1681; A63B 21/4029; A63B 71/0036; A63B 2210/50; A47B 81/005
USPC ..... 211/60.1, 63, 64, 70.5, 70.8, 85.7; 482/92, 93, 94, 97, 104, 106, 107, 110, 482/138, 139; D6/682.2
See application file for complete search history.

(56) References Cited

U.S. PATENT DOCUMENTS

D150,797 S * 8/1948 Lane ..... D6/682.2
2,797,851 A * 7/1957 Leake ..... B60R 9/02 224/546
2,946,452 A * 7/1960 Caloiero ..... A47B 81/005 211/64
3,291,427 A * 12/1966 Hutchings ..... A47B 81/005 224/406
D241,107 S * 8/1976 Ferrara et al. ..... D7/590
4,108,313 A * 8/1978 Bogar, Jr. ..... A47B 81/005 211/106.01
D319,361 S * 8/1991 Moser ..... D6/682.4
5,389,055 A 2/1995 Gangloff
5,524,772 A * 6/1996 Simmons ..... A47B 81/005 211/4

(Continued)

FOREIGN PATENT DOCUMENTS

GB 2516299 A * 1/2015 ..... A63B 21/078
GB 2518437 A 3/2015

OTHER PUBLICATIONS

Mirafit, Mar. 23, 2018, "6 Bar Horizontal Wall Rack", amazon.co.uk, [online], Available from: https://www.amazon.co.uk/Mirafit-Bar-Horizontal-Wall-Rack/dp/B07BQC61KJ?ref_= ast_sto_dp [Accessed Jul. 7, 2020].

*Primary Examiner* — Joshua E Rodden
(74) *Attorney, Agent, or Firm* — Todd A. Serbin; Maynard Nexsen PC

(57) ABSTRACT

A weight rack system, including: at least one upright component provided with at least one cut-out on a front of the at least one upright, wherein the upright component is formed from a single sheet and is of unitary construction.

17 Claims, 7 Drawing Sheets

(56) References Cited

U.S. PATENT DOCUMENTS 5,979,102 A * 11/1999 Sagryn ..... A01K 97/08 114/364
6,086,519 A * 7/2000 Ayton ..... A63B 21/078 482/104
D454,930 S * 3/2002 Novak ..... D21/691
D528,612 S * 9/2006 Black ..... D21/552
7,393,309 B2 * 7/2008 Webber ..... A63B 21/0626 482/135
8,833,570 B2 * 9/2014 Hoppus ..... B23P 17/04 248/225.11
9,156,393 B2 * 10/2015 Sprang, Jr. ..... B60R 11/06
9,333,387 B2 * 5/2016 Hopperstad ..... A63B 21/00047
9,498,670 B1 * 11/2016 Hopperstad ..... A63B 23/1218
D788,234 S * 5/2017 Gregory ..... D21/686
D806,808 S * 1/2018 Gregory ..... D21/686
D884,096 S * 5/2020 Dunahay ..... D21/694
D907,725 S * 1/2021 Adams ..... D21/694
D952,069 S * 5/2022 Adams ..... D21/686
D956,891 S * 7/2022 Küttel ..... D21/686
2001/0004624 A1 * 6/2001 Cournoyer ..... A63B 23/12 482/141
2007/0010381 A1 1/2007 Black
2007/0042876 A1 * 2/2007 Lundquist ..... A63B 21/0783 482/94
2007/0203002 A1 8/2007 Webber
2012/0322622 A1 * 12/2012 Davis ..... A63B 21/00047 482/38
2014/0367351 A1 12/2014 Juen
2015/0083681 A1 * 3/2015 Childs ..... A47F 7/00 211/85.7
2016/0271444 A1 * 9/2016 Payne ..... A63B 23/1236
2018/0326250 A1 * 11/2018 Henniger ..... A63B 23/0405
2019/0387883 A1 * 12/2019 Meyer ..... A47B 81/005
2020/0298051 A1 * 9/2020 Steenekamp ..... A63B 21/4035
2020/0384337 A1 * 12/2020 Brasch ..... A63B 23/1218
2021/0308516 A1 * 10/2021 Sorin ..... A63B 21/078
2023/0045795 A1 * 2/2023 Hopperstad ..... A63B 21/169
2023/0271052 A1 * 8/2023 Juen ..... A63B 71/0036 211/85.7

* cited by examiner

WEIGHT RACK SYSTEM AND METHODS OF MAKING AND USING SAME

RELATED APPLICATIONS

This application claims the benefit of priority under 35 U.S.C. § 119(e) of U.S. Provisional Patent Application No. 63/003,550, filed Apr. 1, 2020, and under 35 U.S.C. § 119(a) of U.K. Patent Application No. 2007330.0, filed May 18, 2020, the contents of which are incorporated herein by reference in their entireties.

FIELD OF THE INVENTION

The present invention, in some embodiments thereof, relates to physical fitness and, more particularly, but not exclusively, to fitness equipment and methods of making and using the equipment.

BACKGROUND OF THE INVENTION

Conventional weight racks are typically assembled from multiple pieces which are welded together to form the weight rack. Examples include the Sorinex® Base Camp™ Rack which can be found at sorinex.com/pages/base-camp-rack-series and the Sorinex® Dark Horse™ rack which can be found at sorinex.com/products/dark-horse-power-rack.

SUMMARY OF THE INVENTION

According to an aspect of some embodiments of the present invention there is provided a weight rack system, comprising: at least one upright component, wherein the upright component is formed from a single sheet and is of unitary construction.

In an embodiment of the invention, the system further comprises at least one protector fastened to the at least one upright component.

In an embodiment of the invention, the at least one upright component is provided with at least one cut-out on a front of the at least one upright.

In an embodiment of the invention, the at least one upright component is provided with at least one attachment point.

In an embodiment of the invention, the at least one upright component is provided with at least one mounting bracket.

In an embodiment of the invention, wherein the at least one mounting bracket includes a top notch.

In an embodiment of the invention, the at least one mounting bracket includes a vertical tab.

In an embodiment of the invention, the at least one upright component is provided with an anchoring bracket.

In an embodiment of the invention, the at least one upright component is a left upright component and a right upright component.

In an embodiment of the invention, the left upright component and the right upright component are disposed in a vertical configuration.

In an embodiment of the invention, the left upright component and the right upright component are disposed in a parallel configuration.

In an embodiment of the invention, the left upright component and the right upright component comprise at least one pair of corresponding cut-outs.

In an embodiment of the invention, the left upright component and the right upright component comprise at least one pair of corresponding top notches.

In an embodiment of the invention, the left upright component and the right upright component comprise at least one pair of corresponding vertical tabs.

According to an aspect of some embodiments of the present invention, there is provided a method of manufacturing an upright of a weight rack system, comprising: shaping and/or sizing a sheet of material for manufacturing; placing the sheet of material on or in a cutting machine; cutting the sheet of material into an upright pattern; and, bending the bracket portions of the upright pattern into desired form.

In an embodiment of the invention, the method further comprises fastening at least one protector to at least one upright.

In an embodiment of the invention, the weight rack system is manufactured by repeating the steps of shaping through cutting to form two identical upright patterns, and wherein the bending is performed in opposite directions for each upright pattern to form a left upright component and a mirror-image right upright component.

In an embodiment of the invention, the resultant desired form is of unitary construction.

According to an aspect of some embodiments of the present invention, there is provided a method of using a weight rack system, comprising: placing an exercise implement into a cut-out and/or a top notch and/or around a vertical tab of an upright of the weight rack system; and/or attaching an exercise implement to an attachment point and/or the vertical tab of the upright of the weight rack system; and, commencing exercise.

In an embodiment of the invention, exercise includes squats, bench press, military press, band work and/or pull-ups.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWING(S)

Some embodiments of the invention are herein described, by way of example only, with reference to the accompanying drawings. With specific reference now to the drawings in detail, it is stressed that the particulars shown are by way of example, are not necessarily to scale and are for purposes of illustrative discussion of embodiments of the invention. In this regard, the description taken with the drawings makes apparent to those skilled in the art how embodiments of the invention may be practiced.

DESCRIPTION OF SPECIFIC EMBODIMENTS OF THE INVENTION

Figure 1:
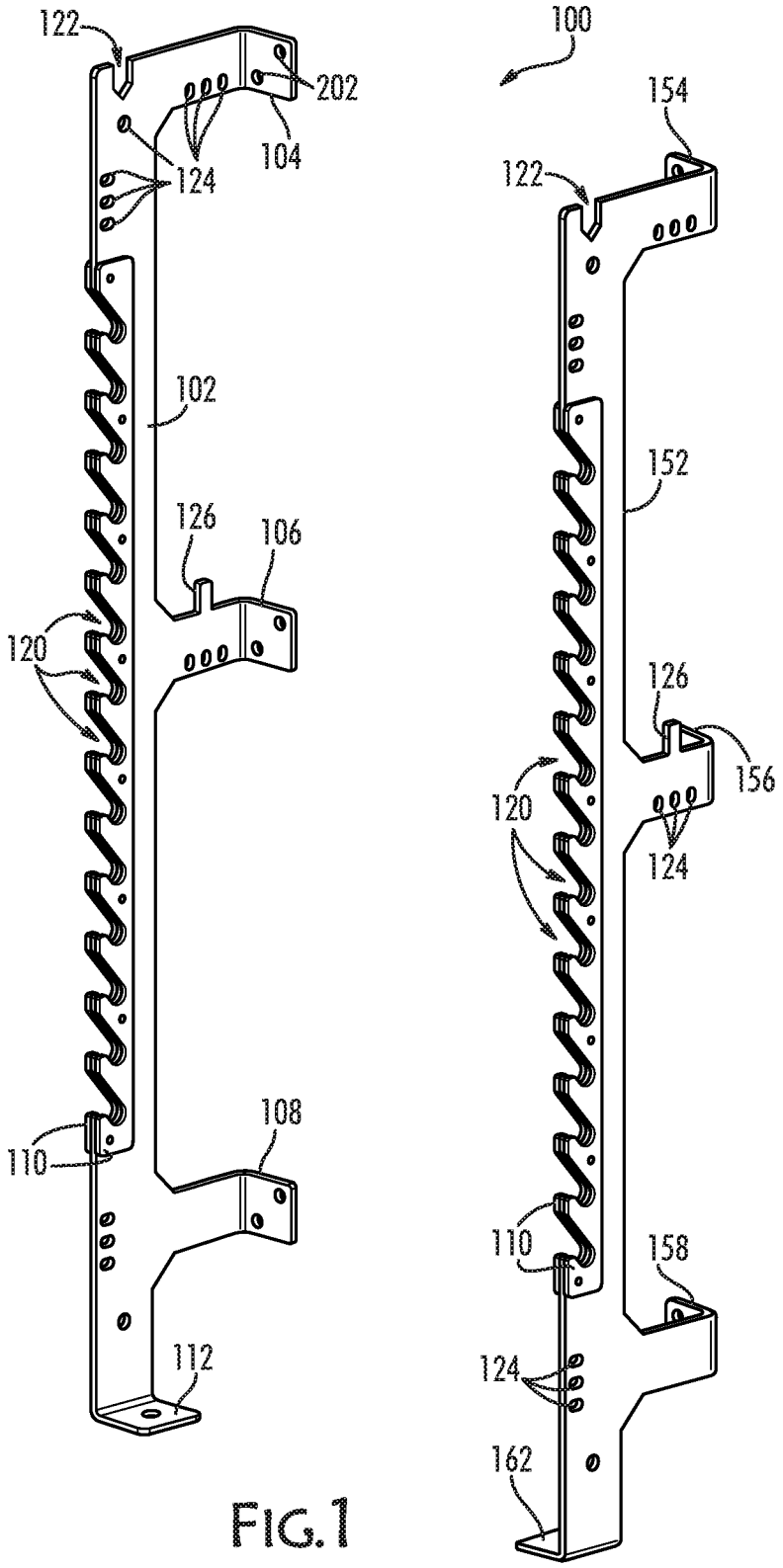
FIG. 1 is a front perspective view of a weight rack system, in accordance with an exemplary embodiment of the invention.

The present invention, in some embodiments thereof, relates to physical fitness and, more particularly, but not exclusively, to fitness equipment and methods of making and using the equipment.

Before explaining at least one embodiment of the invention in detail, it is to be understood that the invention is not necessarily limited in its application to the details of construction and the arrangement of the components and/or methods set forth in the following description and/or illustrated in the drawings. The invention is capable of other embodiments or of being practiced or carried out in various ways.

Figure 6:
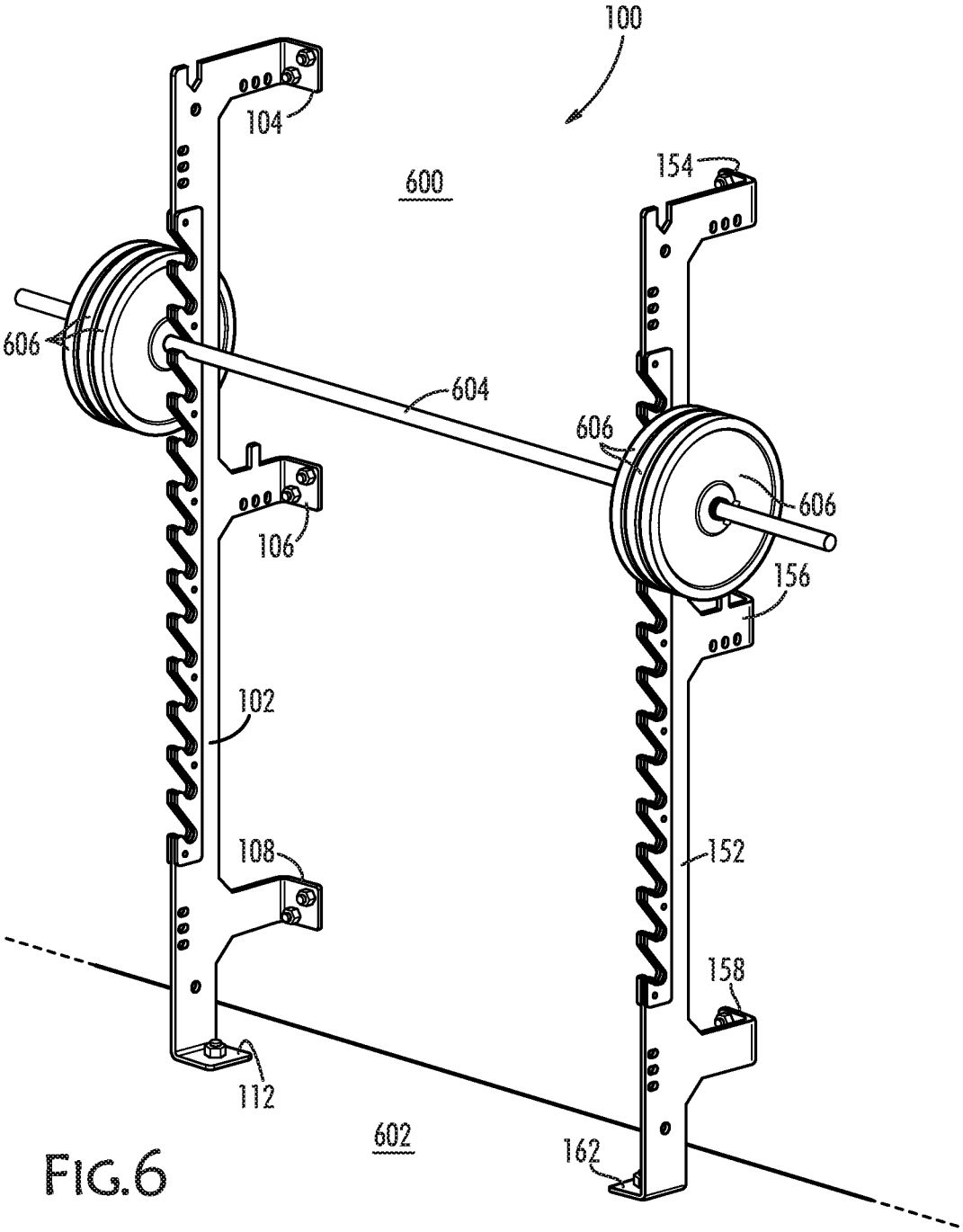
FIG. 6 is a perspective view of a weight rack system mounted to a support and in use with a weight bar, in accordance with an exemplary embodiment of the invention.
Figure 7:
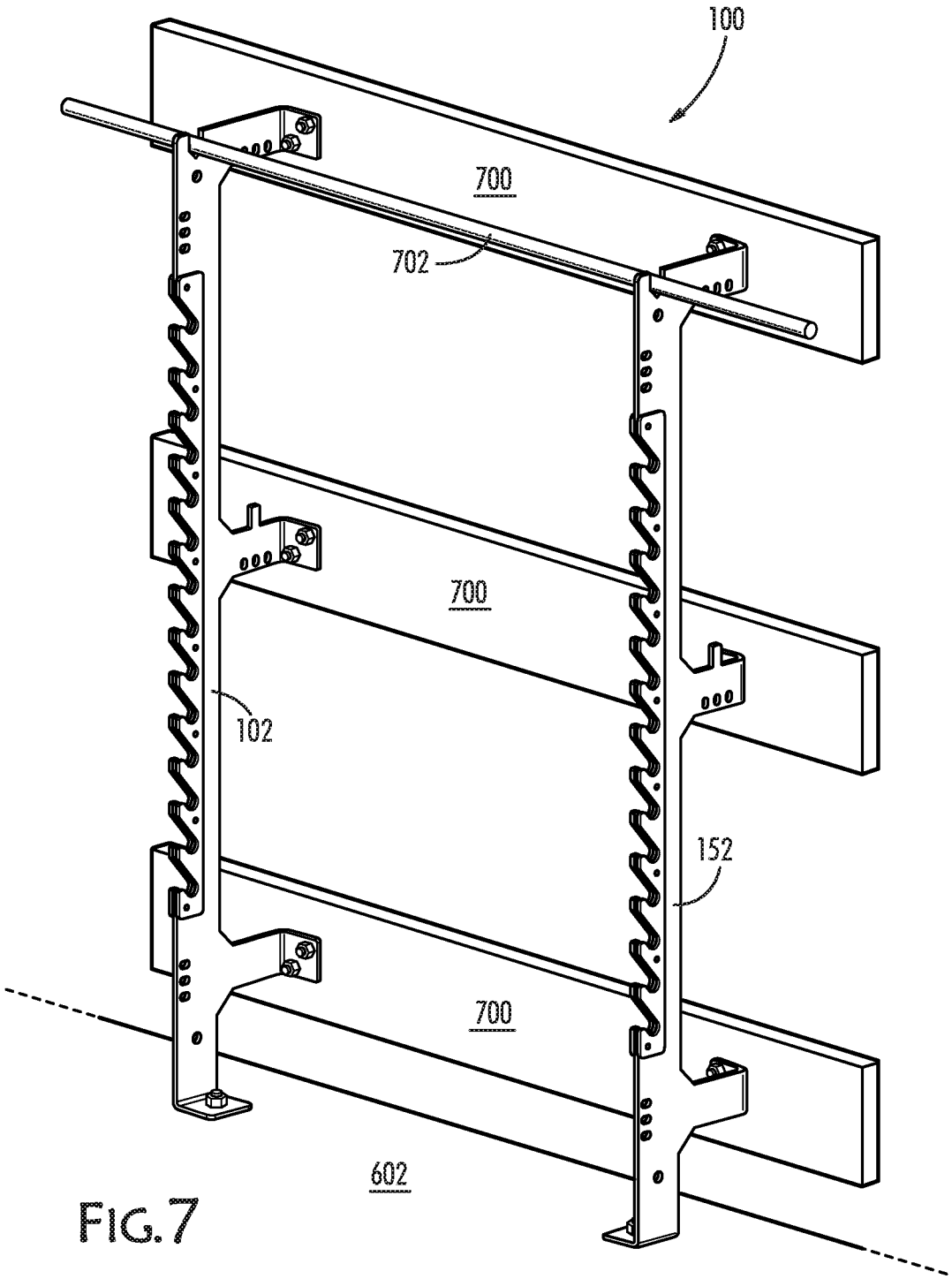
FIG. 7 is a perspective view of a weight rack system mounted to a support and in use with a stored weight bar, in accordance with an exemplary embodiment of the invention.

Referring now to the drawings, FIG. 1 is a front perspective view of a weight rack system 100, in accordance with an exemplary embodiment of the invention. Generally, it should be understood that the weight rack system 100 is usable for the performance of fitness and weight lifting exercise, in some embodiments of the invention. Exemplary features of the weight rack system 100 include ease of manufacture, simplicity of set-up and variety of methods of use due to the unique configuration of the weight rack system 100, as will be explained in more detail below. For the purposes of defining terms as they are used herein, directions such as "left" and "right", "top" and "bottom", "up" and "down", "inside" and "outside" are relative to a viewpoint of a user facing the weight rack system 100 after it is installed, such as shown in FIGS. 6 and 7. For example, "inside" means between the two upright components of the system 100, whereas "outside" means to the left of the left upright or to the right of the right upright.

In an embodiment of the invention, the weight rack system 100 comprises two upright components, a left upright component 102 and a right upright component 152. The upright components 102, 152 are mirror images of one another, in an embodiment of the invention, such that the mounting brackets 104, 106, 108 and 154, 156, 158 on each of the uprights 102, 152, respectively, turn inside to face each other. While three mounting brackets are shown on each upright, it should be understood that there could be more or less mounting brackets. In some embodiments of the invention, anchoring brackets 112, 162 are provided to the uprights 102, 152, respectively, for anchoring the system 100 to an underlying surface, such as the floor. Mounting/anchoring can be achieved using techniques known in the art, such as bolting, screwing, and the like.

In an embodiment of the invention, each upright 102, 152 is configured with a plurality of cut-outs 120 arranged vertically, in series, along the front of each upright. In an embodiment of the invention, there are 10-20 cut-outs 120 on each upright 102, 152. Optionally, there are less than 10 cut-outs 120. Optionally, there are more than 20 cut-outs 120. In some embodiments of the invention, the cut-outs 120 are shaped such that they are angled downwardly with the front of the cut-outs 120 being higher than the rear of the cut-outs 120. In some embodiments of the invention, the cut-outs 120 are sized and shaped to have a weight bar or bar bell positioned therein. For example, the cut-outs 120 are sized and shaped to be able to accommodate an Olympic-sized weight bar. Further, it should be understood that in some embodiments of the invention, when the left upright component 102 and the right upright component 152 are installed (affixed to a support such as a wall), at least some of the cut-outs 120 on each upright 102, 152 correspond to each other such that a weight bar could be mounted horizontally between the left component upright 102 and the right component upright 152, such as shown in FIG. 6. Optionally, each cut-out 120 on the left upright 102 has a corresponding cut-out 120 on the right upright 152. In some embodiments of the invention, the uprights 102, 152 are constructed of a substantially rigid and strong material like steel.

In some embodiments of the invention, a protector 110 is provided to at least one cut-out 120 on an upright 102, 152. Two protectors 110, one on each side of the cut-outs 120 could be fastened together using screws, nut and bolt, and the like, using protector fastening holes placed in the uprights for such a purpose. Additionally, alternatively and/or optionally, at least one protector 110 is attached to an upright using an adhesive. The protectors 110 shown in FIG. 1 vertically traverse the full array of cut-outs 120 and are located on the inside and outside of the cut-outs 120 on each upright 102, 152. Optionally, only a single protector 110 is provided, located on only one side of the cut-out 120. In some embodiments of the invention, the protector 110 is constructed of fibrous and/or plastic and/or rubber and/or woven and/or polymeric material.

In some embodiments of the invention, a top notch 122 is provided to each upright 102, 152, wherein the top notches 122 correspond to each other when the left upright component 102 and the right upright component 152 are installed such that a weight bar, or other component having a major longitudinal axis, can be placed horizontally across the inside space between the uprights 102, 152, such as shown in FIG. 7. Such a configuration could be used simply for storing a weight bar, or in some embodiments, for performing exercises such as pull-ups. Attachment points 124 (typically, holes and/or slits and/or apertures) are disposed on the uprights 102, 152 at various locations for the attachment of carabiners or other clips, snaps and the like to attach additional exercise implements (e.g. bands, safety straps) to the system 100. While the FIGS. show a specific configuration of attachment points 124, it should be understood that they could be located anywhere on the uprights 102, 154 and one upright's configuration could be different than the other's. Also shown in FIG. 1 is a tab 126, located on the middle mounting brackets 106, 156, which can also be used for attaching something to the system 100 and/or could be used (when the system 100 is installed) for additional storage, for example of a weight bar placed between the vertical tabs 126 and the wall and/or of a weight bar placed forward of the vertical tabs 126.

Figure 2:
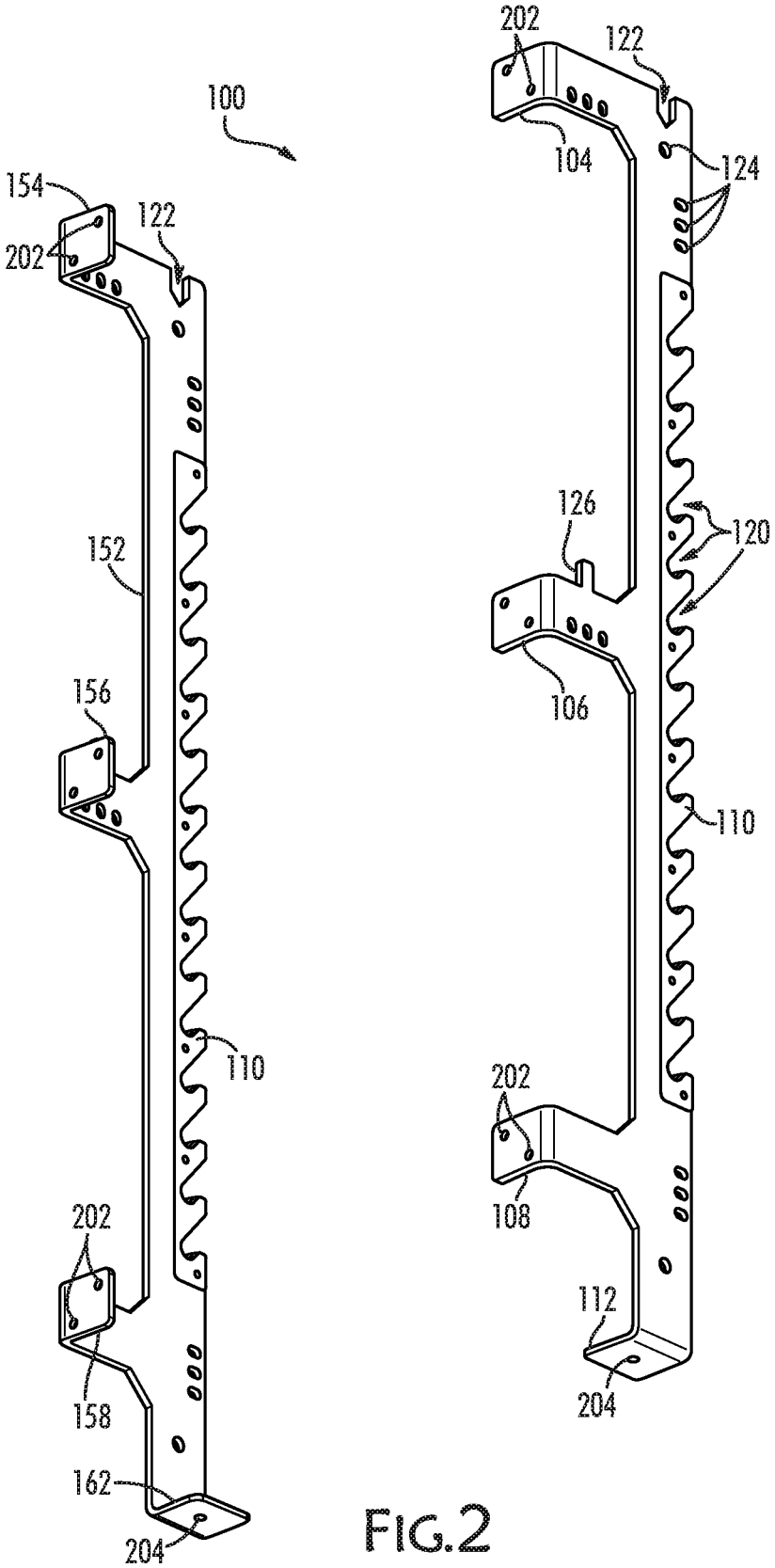
FIG. 2 is a rear perspective view of a weight rack system, in accordance with an exemplary embodiment of the invention.

FIG. 2 is a rear perspective view of the weight rack system 100, in accordance with an exemplary embodiment of the invention. In some embodiments of the invention, at least one of the mounting brackets 104, 106, 108 and 154, 156, 158 on each upright 102, 152 is provided with a mounting hole 202 for placing a bolt or screw through to attach the upright 102, 152 to an underlying support, such as a wall or stud. Optionally, the hole 202 is threaded, for example when being used with screws. Optionally the diameter of the hole 202 is designed to be slightly smaller than the diameter of the bolt or screw so that the bolt or screw is secured at least by a compression fit. Similarly, anchoring holes 204 are provided to the anchoring brackets 112, 162.

Figure 3A:
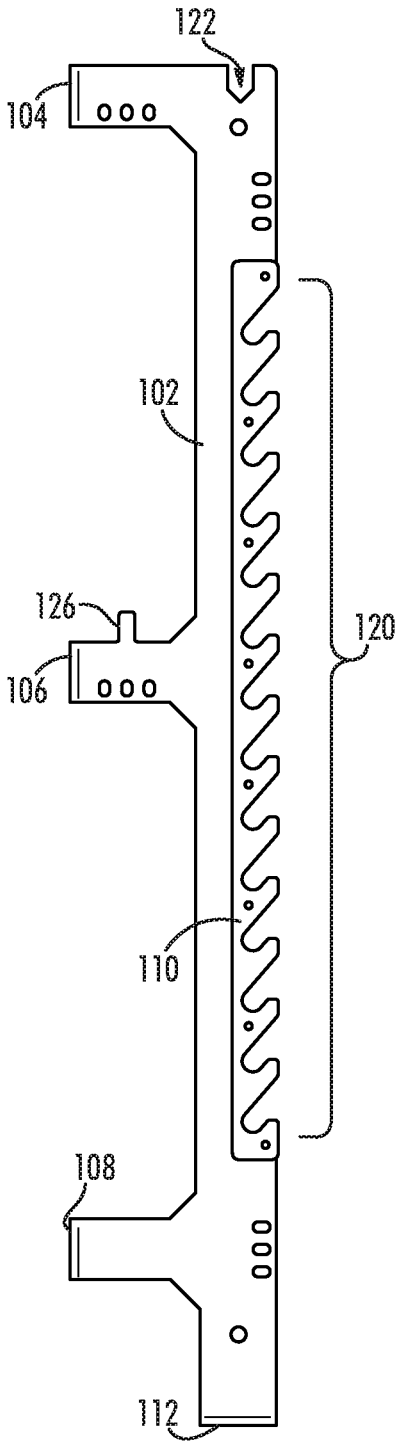
FIG. 3A is an outside side view of a left upright of a weight rack system, in accordance with an exemplary embodiment of the invention.
Figure 3B:
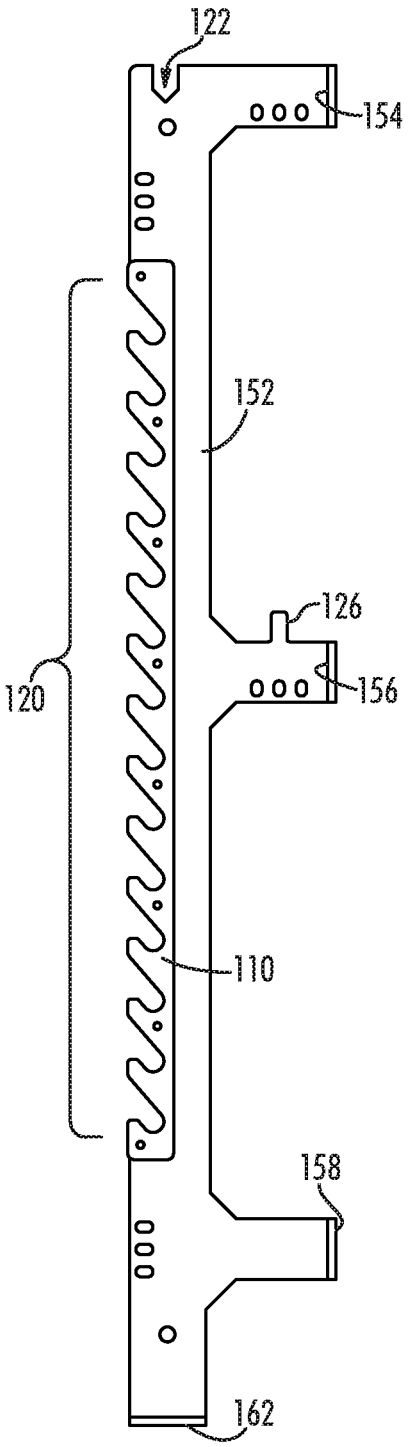
FIG. 3B is an outside side view of a right upright of a weight rack system, in accordance with an exemplary embodiment of the invention.

FIG. 3A is an outside side view of the left upright 102 of the weight rack system 100, in accordance with an exemplary embodiment of the invention, and FIG. 3B is an outside side view of the right upright 152 of a weight rack system 100, in accordance with an exemplary embodiment of the invention.

Figure 4:
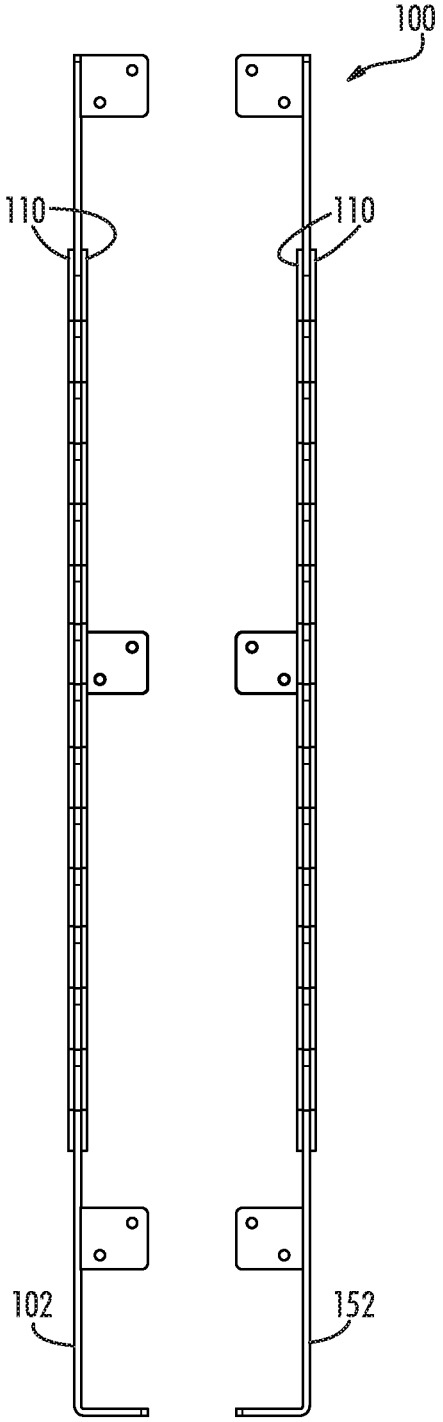
FIG. 4 is a front view of a weight rack system, in accordance with an exemplary embodiment of the invention.
Figure 5:
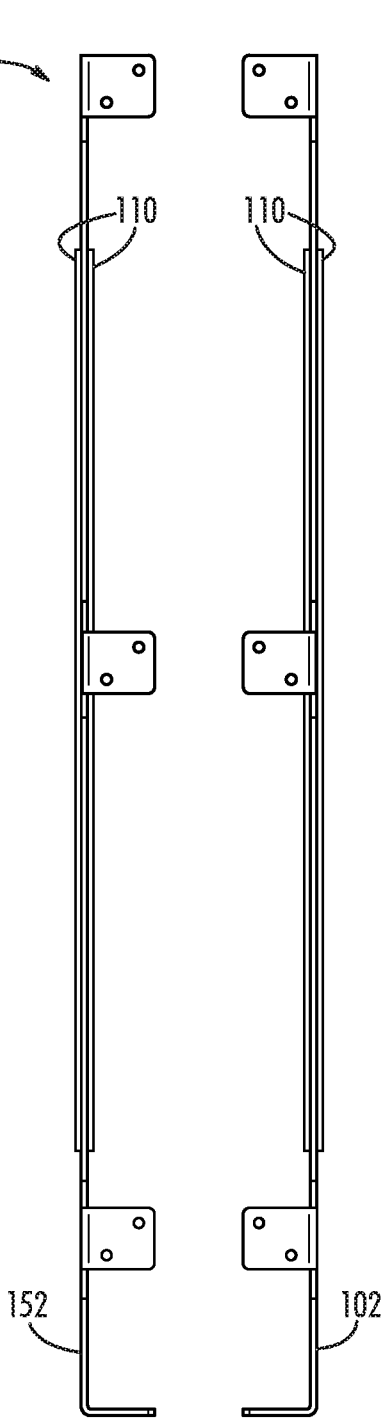
FIG. 5 is a rear view of a weight rack system, in accordance with an exemplary embodiment of the invention.

FIG. 4 is a front view of a weight rack system 100 showing both the left upright component 102 and the right upright component 152 side by side, in accordance with an exemplary embodiment of the invention. It should be understood that after installation, there would nominally be sufficient space between the uprights 102, 152 for a user to stand and exercise. In some embodiments of the invention, the space between the uprights is between 30-60 inches. From this view (and FIG. 5), the protectors 110 on the uprights 102, 152 can be clearly seen, wherein the protectors 110 act as a form of covering to the underlying uprights. FIG. 5 is a rear view of the weight rack system 100, in accordance with an exemplary embodiment of the invention.

In some embodiments of the invention, each upright is between 70-95 inches high. In some embodiments of the invention the depth of each upright (from the front face to a back side of the mounting brackets facing the support surface) is 12-16 inches. In some embodiments of the invention, each cut-out is separated by 3-5 inches. In some embodiments of the invention, the mounting brackets are evenly spaced apart vertically. Optionally, the mounting brackets are unevenly spaced apart vertically. In some embodiments of the invention, the lower mounting bracket on an upright is between 6-12 inches above the underlying surface (e.g. floor). It should be understood that these dimensional ranges are by way of example and that the dimensional numbers could be larger or smaller or the ranges could be larger or smaller, depending on the user's individual needs. It should also be understood that because these upright components are cut from a single sheet of material and are of unitary construction, it is only a matter of altering the cutting pattern to alter the dimensions and/or shape and/or configuration of the uprights.

FIG. 6 is a perspective view of the weight rack system 100 mounted to a support 600 (in this case, a wall) and in use with a weight bar 604, in accordance with an exemplary embodiment of the invention. In an embodiment of the invention, the weight bar 604 is placed into two cut-outs 120 which correspond with one another and wherein each corresponding cut-out 120 is located on the left upright component 102 and the right upright component 152, respectively, such that the weight bar 604 traverses the interior between the uprights 102, 152 in a horizontal configuration. In some embodiments of the invention, the weight bar 604 is used with weight plates 606. It can be seen that when the system 100 is installed, in an embodiment of the invention, the anchoring brackets 112, 162 are attached to the floor 602, and at least one of the mounting brackets 104, 106, 108, 154, 156, 158 on each upright are attached to the support 600 (wall).

FIG. 7 is a perspective view of the weight rack system 100 mounted to a support 700 (in this case, multiple studs) and in use with a stored weight bar or a pull-up bar 702 positioned within the top notches 122 of the uprights 102, 152, in accordance with an exemplary embodiment of the invention. In an embodiment of the invention, a user can exercise using the bar 702 in the overhead position, for example performing pull-ups or other overhead-centric exercises.

Figure 8:
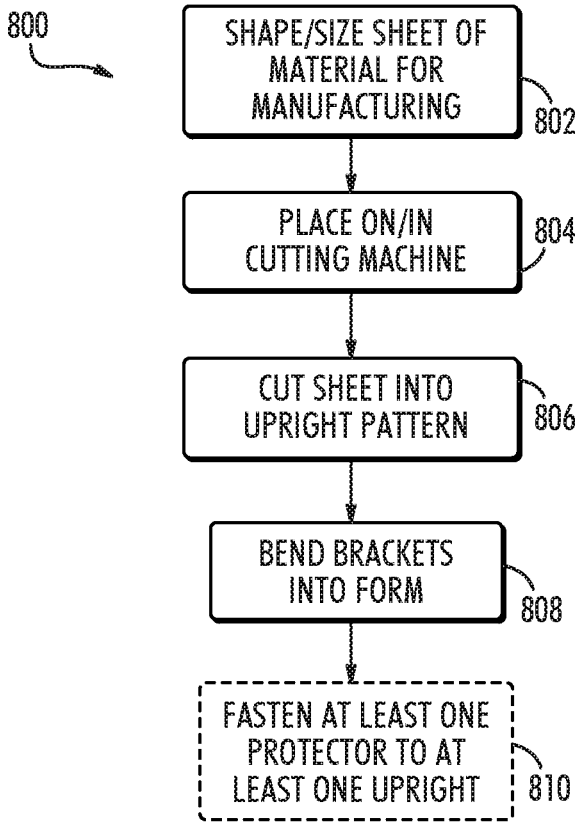
FIG. 8 is a flowchart of a method of manufacturing a weight rack system, in accordance with an exemplary embodiment of the invention.

FIG. 8 is a flowchart 800 of a method of manufacturing the weight rack system 100, in accordance with an exemplary embodiment of the invention. It should be understood that one advantage of the weight rack systems 100 described herein is their ease of manufacture. It is intended, in some embodiments of the invention, that each upright 102, 152 is made from a unitary piece of material (not including the optional protectors 110) and can be made in one, continuous cutting operation using a single sheet, for example a sheet of steel. In an embodiment of the invention, a sheet of material is shaped and/or sized (802) for placement (804) onto/into a cutting machine. The cutting machine then cuts (806) the sheet to form a flat form upright 102, 152, wherein the mounting brackets and the anchoring brackets are formed but are still flat, in the same plane as the remainder of the upright. Cutting (806) is also used to create the top notch 122, at least one cut-out 120, and the vertical tab 126 features of an upright. In some embodiments, cutting (806) also creates at least one of the attachment points 124, at least one of the mounting holes 202, at least one of the anchoring holes 204 and/or at least one protector fastening hole.

It should be noted that both uprights 102, 152 described herein are cut using the same pattern and then the mounting brackets and the anchoring brackets are bent (808) into desired configuration depending on whether the left upright component 102 or the right upright component 152 is being produced. More specifically, the mounting brackets and the anchoring brackets for each upright are bent inwardly (when viewed by a user from an installed standpoint), in opposite directions relative to one another depending whether the upright is the left upright component 102 or the right upright component 152.

In an embodiment of the invention, the cutting machine can utilize laser, water, mechanical, plasma, and/or oxy-fuel as examples. It should be noted that using the manufacturing process described herein, a weight rack can be constructed without attaching any parts together and/or without have to performing any welding (apart from potentially using oxy-fuel cutting to create upright shape from the sheet of material in the first place).

Optionally, at least one protector 110 is fastened (810) to at least one cut-out 120 of at least one of the manufactured uprights 102, 152. Optionally, a pair of protectors 110 are attached to each other, one on each side of the upright, such as shown in FIGS. 4 and 5.

Figure 9:
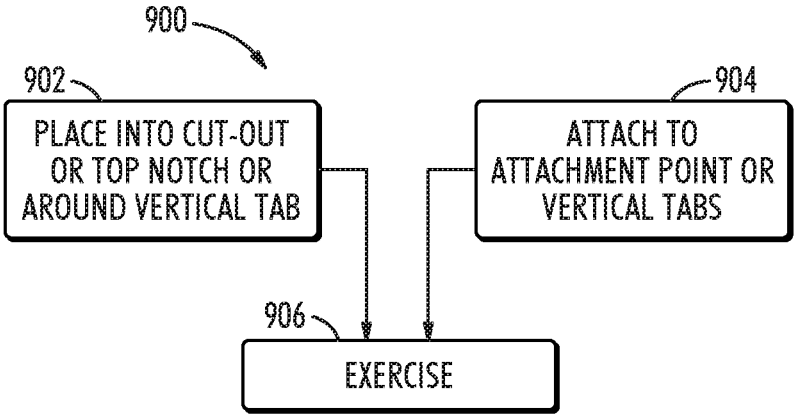
FIG. 9 is a flowchart of a method of using a weight rack system, in accordance with an exemplary embodiment of the invention.

FIG. 9 is a flowchart 900 of a method of using the weight rack system 100, in accordance with an exemplary embodiment of the invention. Once the left upright component 102 and the right upright component 152 are affixed in to a support, such as a wall or a plurality of horizontal or vertical studs, such that a user can stand in between them, the user places (902) at least one exercise implement on and/or attaches (904) at least one exercise implement to at least one of the uprights 102, 152. For example, weight bars or pull-up bars or bar bells are optionally placed in the cut-outs 120, in the top notches 122, and/or adjacent to the vertical tabs 126. As another example, a band could be attached to any one of the attachment points 124, using a connector such as a carabiner, snap and/or clasp, or the band could be placed around the vertical tab. It should be understood that these are by way of example only, and that only the imagination of the user limits how and what could be attached to one or more of the uprights in order to perform exercise.

The user then commences (906) exercise using one or more exercise implements which have been placed on or attached to at least one upright of the system 100. Commonly performed exercises include doing squats (by lifting the weight bar 604 out of the cut-outs 120 and then performing the squat exercise motion at least once before placing the weight bar 604 back into the cut-outs), pull-ups (by grabbing an overhead bar placed/stored in the top notches 122 and spanning across the interior space between the uprights, or even benching the weight bar 604 (by placing a weight bench in the interior space and locating the weight bar 604 in cut-outs 120 which are reachable when the user is laying down on the bench).

It should be understood that while in most use scenarios, the uprights 102, 152 are placed in a vertical configuration to form the system 100, they could be angled and/or horizontally placed. Further, it is conceivable that only one of the uprights is installed. Further, they do not need to be installed parallel to one another when being used in the system 100.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

The term "plurality" means "two or more".

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A weight rack system, comprising:

a left upright component and a right upright component, provided with at least one cut-out on a front of the left upright component and right upright component, wherein at least one of the upright components includes a top notch, respectively, and each upright component comprises at least two mounting brackets having an attachment portion at the free end thereof, the attachment portion projecting transversely from the respective mounting brackets and having a face for securing to a support surface, wherein each mounting bracket projects from the respective upright component to create sufficient space between a support surface to which the component is mounted and the upright components to enable a user to stand and exercise, and at least one of the left upright component and the right upright component further comprising an anchoring bracket configured for attachment to a surface underlying the upright, wherein the left upright component and the right upright component, including the at least one cut-out and the at least two mounting brackets on each of the left and right upright components, are each formed from a single sheet of material and are of unitary construction, including all of the at least one mounting brackets, and, together, form the weight rack system.

2. The weight rack system according to claim 1, further comprising at least one protector fastened to at least one of the left upright component and the right upright component.

3. The weight rack system according to claim 1, wherein the at least one cut-out numbers 2-20 cut-outs.

4. The weight rack system according to claim 1, wherein the at least one cut-out is vertically arranged on the front of at least one of the left upright component and the right upright component.

5. The weight rack system according to claim 1, wherein at least one of the left upright component and the right upright component is provided with at least one attachment point.

6. The weight rack system according to claim 1, wherein at least one of the mounting brackets includes a vertical tab.

7. The weight rack system according to claim 1, wherein the left upright component and the right upright component are disposed in a vertical configuration.

8. The weight rack system according to claim 1, wherein the left upright component and the right upright component are disposed in a parallel configuration.

9. The weight rack system according to claim 1, wherein the left upright component and the right upright component comprise at least one pair of corresponding cut-outs.

10. The weight rack system according to claim 1, wherein the left upright component and the right upright component comprise at least one pair of corresponding top notches.

11. The weight rack system according to claim 1, wherein the left upright component and the right upright component comprise at least one pair of corresponding vertical tabs.

12. A method of manufacturing a weight rack system according to claim 1, comprising: shaping and/or sizing a single sheet of material for manufacturing for each of the left upright component and the right upright component, respectively: placing each sheet of material on or in a cutting machine; cutting each sheet of material into an upright pattern including the at least one cut-out on the front of the upright pattern;

and, bending bracket portions of the upright patterns cut from each sheet of material into desired form to form the left upright component and the right upright component, respectively, wherein the resultant desired form of each upright component is of unitary construction, and each upright component comprises the at least two mounting brackets, all of the at least two mounting brackets being of unitary construction with each upright component, respectively, having the attachment portion at the free end thereof, the attachment portion projecting transversely from the respective mounting brackets and having the face for securing to the support surface, and at least one of the left upright component and the right upright component further comprises the top notch.

13. The method according to claim 12, wherein the at least one cut-out numbers 2-20 cut-outs vertically arranged on the front of the at least one upright.

14. The method of claim 12, further comprising fastening at least one protector to the at least one upright.

15. The method of claim 12, wherein the weight rack system is manufactured by repeating the steps of shaping through cutting to form two identical upright patterns, and wherein the bending is performed in opposite directions for each upright pattern to form the left upright component and the right upright component as a mirror-image of the left upright component.

16. A method of using a weight rack system according to claim 1, comprising: placing an exercise implement into the cut-out and/or the top notch and/or around a vertical tab of the left or right upright components of the weight rack system; and/or attaching the exercise implement to an attachment point and/or the vertical tab of the left or right upright component of the weight rack system; and, commencing exercise.

17. The method of claim 16, wherein exercise includes squats, bench press, military press, band work and/or pull-ups.

* * * * *